US010399766B2

(12) United States Patent
Fritzler et al.

(10) Patent No.: US 10,399,766 B2
(45) Date of Patent: Sep. 3, 2019

(54) TEARABLE LOCK CLOSURE FOR FLUID DISPENSING CAPS

(71) Applicant: Precision Valve Corporation, Greenville, SC (US)

(72) Inventors: Ruben A. Fritzler, Buenos Aires (AR); Eugenio G. Bergoglio, Buenos Aries (AR)

(73) Assignee: Precision Valve Corporation, Greenville, SC (US)

( * ) Notice: Subject to any disclaimer, the term of this patent is extended or adjusted under 35 U.S.C. 154(b) by 0 days.

(21) Appl. No.: 15/878,174

(22) Filed: Jan. 23, 2018

(65) Prior Publication Data

US 2018/0155112 A1 Jun. 7, 2018

Related U.S. Application Data

(63) Continuation of application No. PCT/US2016/043865, filed on Jul. 25, 2016.

(30) Foreign Application Priority Data

Jul. 24, 2015 (AR) ..... P20150102352

(51) Int. Cl.
*B65D 83/22* (2006.01)
*B65D 83/20* (2006.01)
*B65D 83/38* (2006.01)

(52) U.S. Cl.
CPC ..... *B65D 83/228* (2013.01); *B65D 83/201* (2013.01); *B65D 83/38* (2013.01); *B65D 83/206* (2013.01)

(58) Field of Classification Search
CPC ..... B65D 83/228; B65D 83/201; B65D 83/38
See application file for complete search history.

(56) References Cited

U.S. PATENT DOCUMENTS 3,373,908 A * 3/1968 Crowell ..... B65D 83/205 222/402.13
3,480,184 A * 11/1969 Landis ..... B65D 83/40 220/265

(Continued)

FOREIGN PATENT DOCUMENTS

CN 2855935 1/2007
CN 103402649 11/2013

(Continued)

OTHER PUBLICATIONS

International Search Report dated Oct. 20, 2016 from corresponding International PCT Application PCT/US2016/043865, 4 pages.

(Continued)

*Primary Examiner* — David P Angwin
*Assistant Examiner* — Bob Zadeh
(74) *Attorney, Agent, or Firm* — Ohlandt, Greeley, Ruggiero & Perle, L.L.P.

(57) ABSTRACT

A fluid dispensing cap has a trigger vertically operable to actuate a valve. The cap has a window located below the trigger. The window defines a side edge and a bottom edge of the cap. A plate has a tab projecting therefrom. The plate also has a bottom surface with a channel. The plate is disposed in the window. A linking rib connects the plate to the side edge of the cap. The bottom edge is disposed in the channel. Movement of the trigger to actuate the valve is prevented until the plate and tab are affirmatively removed.

15 Claims, 12 Drawing Sheets

(56) References Cited

U.S. PATENT DOCUMENTS

| | | | | |
|---|---|---|---|---|
| 3,744,682 | A * | 7/1973 | Blank | B65D 83/206 222/402.11 |
| 3,749,286 | A | 7/1973 | Douglas | |
| 3,848,778 | A * | 11/1974 | Meshberg | B65D 83/205 222/402.11 |
| 4,067,482 | A * | 1/1978 | Vogel | B65D 83/206 222/153.11 |
| 5,058,775 | A * | 10/1991 | Gross | B65D 47/2006 215/235 |
| 5,242,085 | A * | 9/1993 | Richter | B65D 1/0215 215/12.1 |
| 5,529,218 | A | 6/1996 | Favre et al. | |
| 6,283,333 | B1 * | 9/2001 | Knickerbocker | B65D 47/2006 222/153.14 |
| 6,405,885 | B1 * | 6/2002 | Elliott | B65D 47/0838 215/237 |
| 7,367,476 | B2 | 5/2008 | Law et al. | |
| 7,690,535 | B2 | 4/2010 | Law et al. | |
| 9,598,225 | B2 * | 3/2017 | Patil | B05B 11/0027 |
| 9,776,785 | B2 * | 10/2017 | Hanson | B65D 83/202 |
| 2004/0182884 | A1 | 9/2004 | Tada | |
| 2014/0084026 | A1 | 3/2014 | Gillespie et al. | |
| 2014/0367410 | A1 * | 12/2014 | Tryon | B65D 83/205 239/11 |
| 2016/0001959 | A1 * | 1/2016 | Long, Sr. | B65D 83/06 222/81 |
| 2018/0155112 | A1 * | 6/2018 | Fritzler | B65D 83/201 |

FOREIGN PATENT DOCUMENTS

| | | |
|---|---|---|
| EP | 2092986 | 8/2009 |
| JP | 2002-326681 | 11/2002 |
| WO | 01/40078 A1 | 6/2001 |

OTHER PUBLICATIONS

Written Opinion dated Oct. 20, 2016 from corresponding International PCT Application PCT/US2016/043865, 6 pages.

International Preliminary Report on Patentability dated Feb. 8, 2018 from corresponding International PCT Application PCT/US2016/043865, 7 pages.

Chinese Office Action dated Jan. 23, 2019 in corresponding Chinese Patent Application No. 201680041448.5, 15 pages.

Extended European Search Report dated Feb. 12, 2019 in corresponding European Patent Application No. 16831191.8, 9 pages.

* cited by examiner

TEARABLE LOCK CLOSURE FOR FLUID DISPENSING CAPS

CROSS REFERENCE TO RELATED APPLICATIONS

This application is a continuation of International Application PCT/US16/43865 filed on Jul. 25, 2016 that claims priority to Argentinian Patent Application No. ARP20150102352 filed on Jul. 24, 2015, the entire content of these is hereby incorporated by reference herein

BACKGROUND OF THE DISCLOSURE

1. Field of the Disclosure

The present disclosure is directed to a tearable lock closure for use with fluid dispensing caps. The present disclosure also relates to such a tearable lock closure that prevents unintentional trigger actuation.

2. Description of the Related Art

Closures, seals and secure locks are applied to PET containers containing carbonated beverages, for the purpose of preventing unintentional or premature opening.

For example, PET water bottles have a threaded cap connected by thin bridges to a plastic band. The bridges prevent unintentional rotation of the threaded cap by requiring a minimum threshold rotational force to sever the bridges to separate the cap from the band to allow dispensing.

Such lock mechanisms can also be used on other containers. However, there exist several shortcomings with regard to the assembly and operation of container caps that incorporate locks, as well as their performance and use thereof by the user. In most situations, the incorporated locks remain incorporated after the locks are torn to allow for trigger actuation. However, it is undesirable and undermines normal performance of the container for the lock to remain incorporated to the cap.

Furthermore, it has been found that, in some cases, the locking function fails when pressure on the trigger is prolonged, permanent, or more forceful than intended. Even accidental touches can result in a more significant impact than expected.

Still further, it is known that during palletization of these containers, stretch films are wrapped around a group of containers to prevent undesired movements during shipment. However, pressure from the stretch films can act on a container's trigger, and the incorporated lock can become partially or completely torn. Thus, the lock is broken and actuation cannot be prevented.

SUMMARY OF THE DISCLOSURE

The present disclosure provides a tearable lock closure that is incorporated in a liquid dispensing cap of a disposable liquid container to prevent trigger actuation until the tearable lock closure is consciously removed by a human.

The present disclosure also provides such a tearable lock closure incorporated in a fluid dispensing cap of a container.

The present disclosure further provides such a tearable lock closure that is interposed with a hand actuatable trigger that operates a valve that, in turn, regulates dispensation of fluid.

The present disclosure also provides such a tearable lock closure that prevents tampering and undesired dispensation of the fluid when the container is being handled and not intended to be used. Such non-intended to be used examples include, but are not limited to, shipping, distribution, display on shelves and fridges, prior to purchase, and even prior to actuation by the consumer for the use thereof.

The present disclosure still further provides such a tearable lock closure that includes a plate that is mounted on the dispensing cap, in a manner interposed to the trigger, thus preventing actuation thereof, either in a tamper-proof manner or due to unexpected involuntary impacts or accidental touches that may occur while handling the container as stated hereinabove.

The present disclosure yet further provides such a tearable lock closure that is fixed to the cap by attachment points that are hand-tearable, such that fluid dispensation can only be actuated once the tearable lock closure has been intentionally removed by a user.

The above and other objects, features, and advantages of the present disclosure will be apparent and understood by those skilled in the art from the following detailed description, drawings, and accompanying claims.

DETAILED DESCRIPTION OF THE DISCLOSURE

Figure 1:
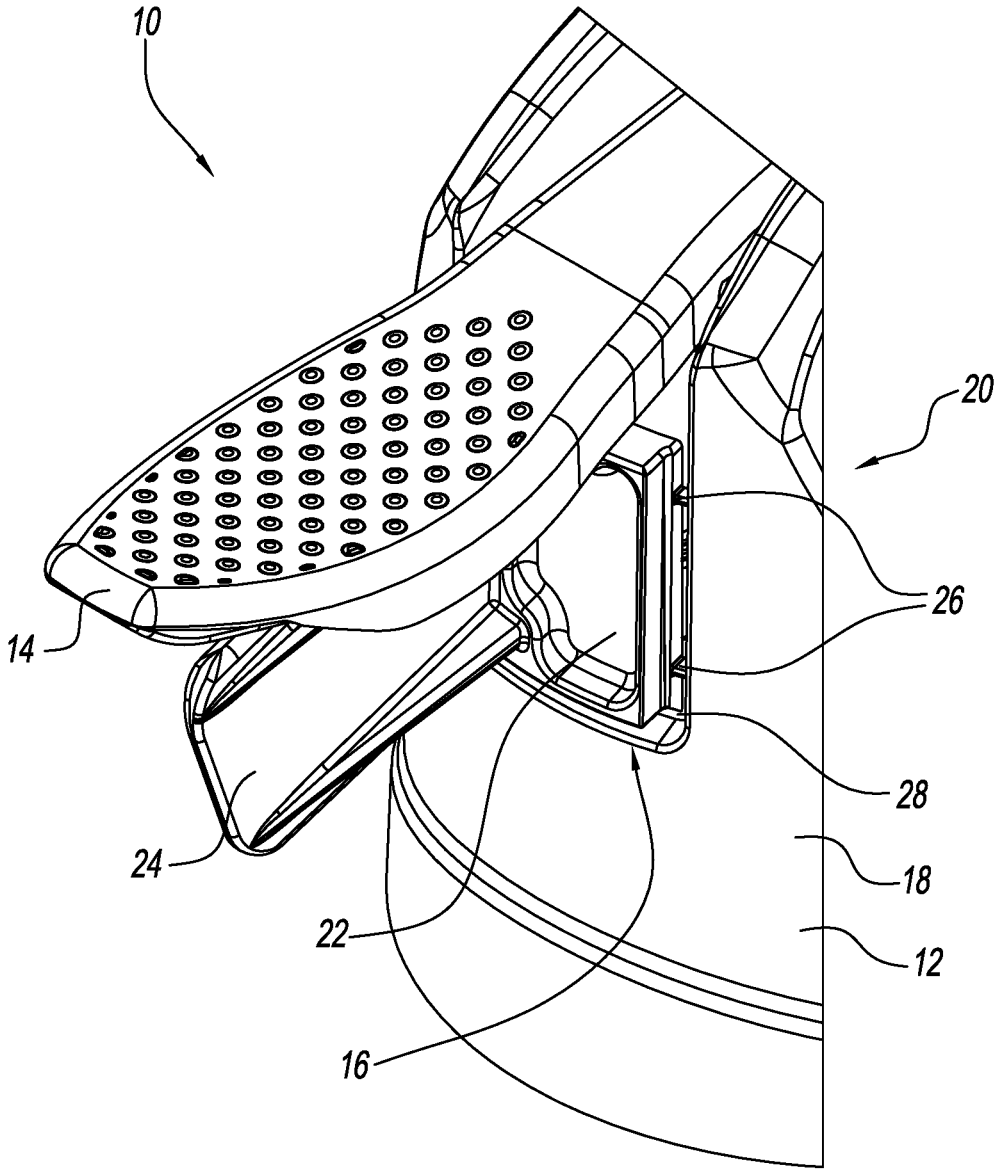
FIG. 1 is a partial, front perspective view showing a portion of a fluid dispensing cap with tearable lock closure according to the present disclosure.
Figure 2:
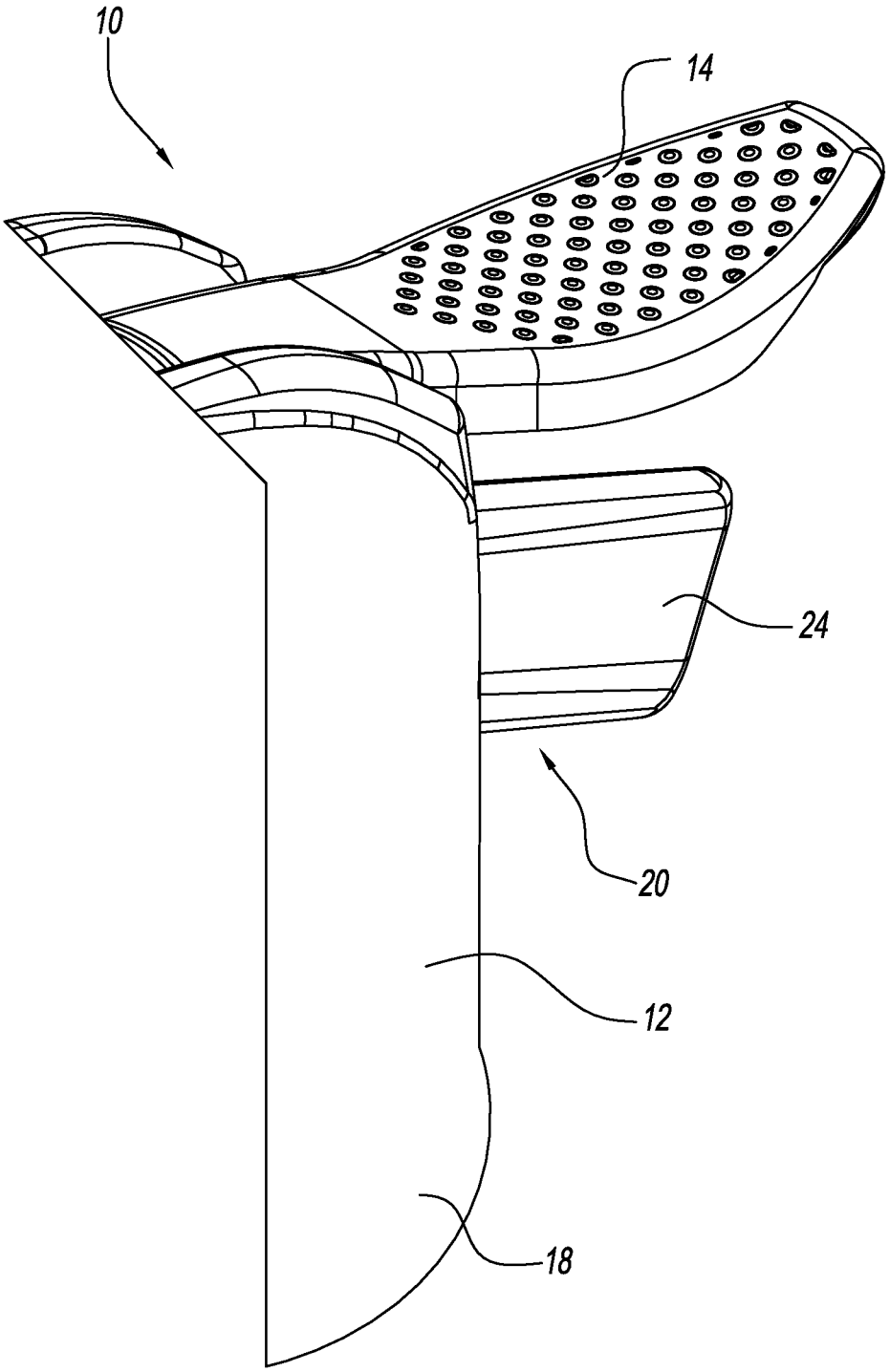
FIG. 2 is a partial, rear perspective view showing a portion of the fluid dispensing cap of FIG. 1.
Figure 4:
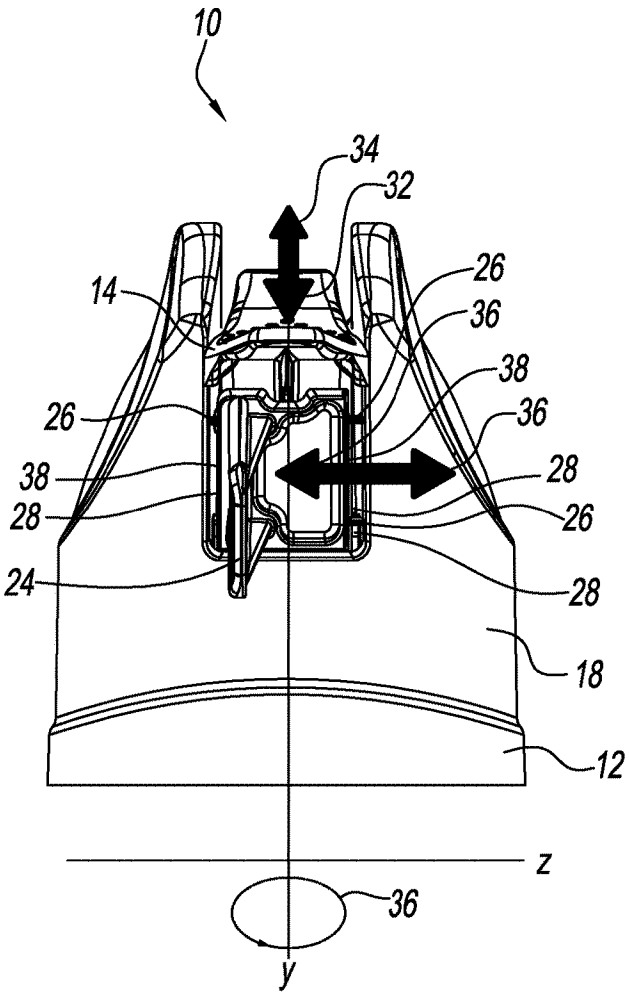
FIG. 4 is a front view of the fluid dispensing cap of FIG. 1.
Figure 3:
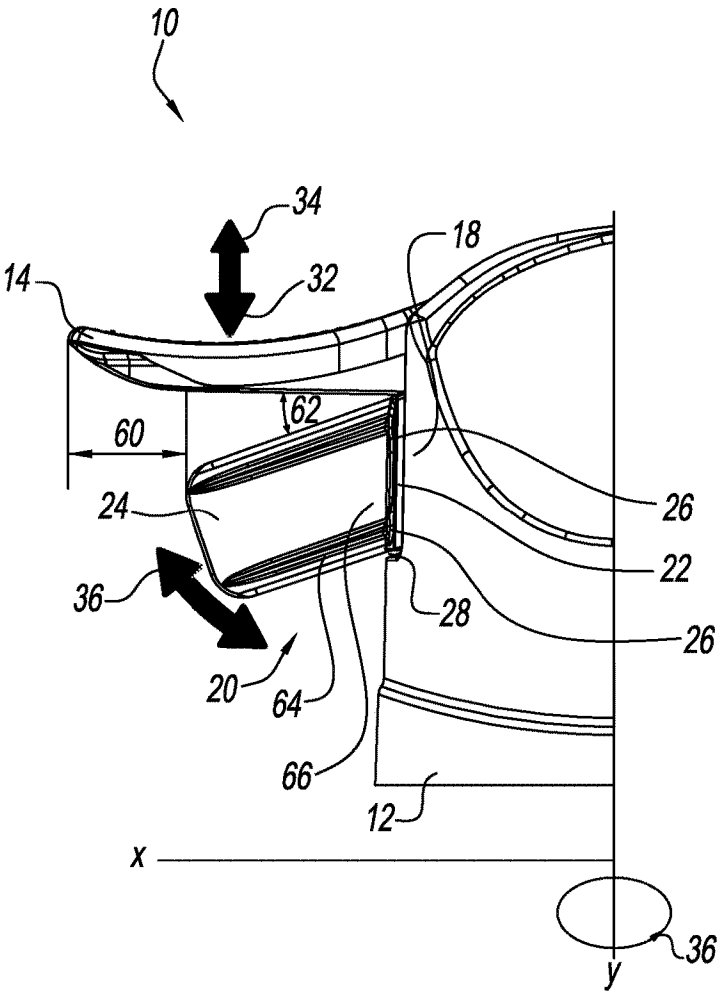
FIG. 3 is a side view of a portion of the fluid dispensing cap of FIG. 1.
Figure 6:
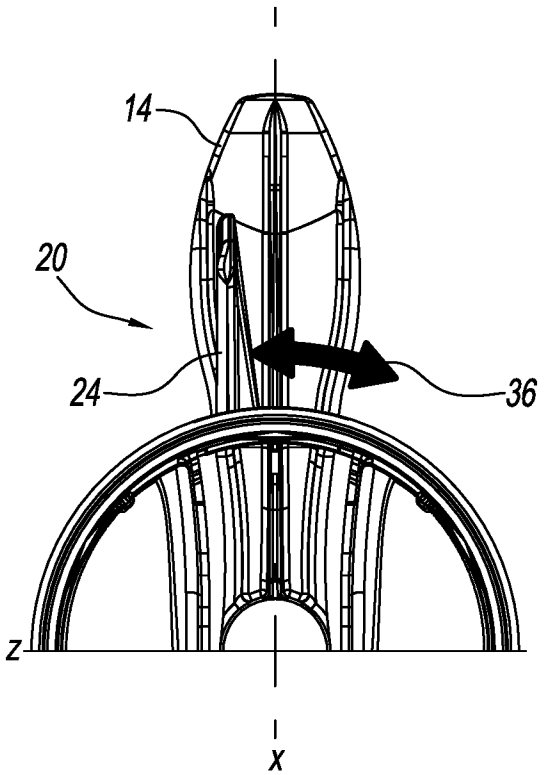
FIG. 6 is a bottom view of fluid dispensing cap of FIG. 1.
Figure 5:
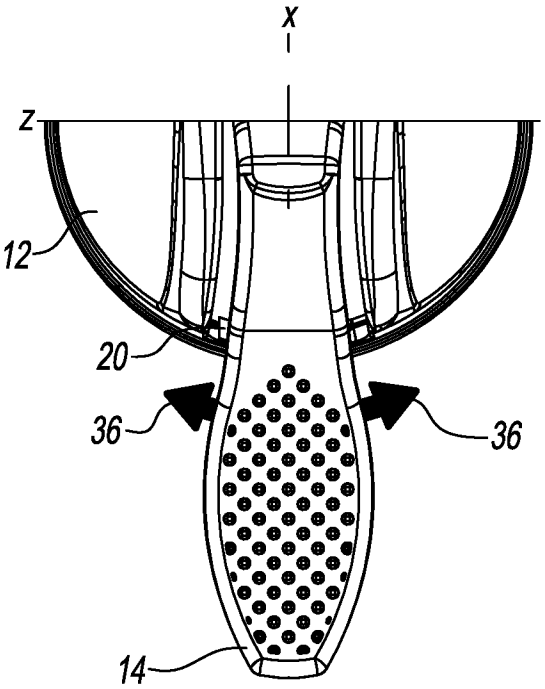
FIG. 5 is a top view of fluid dispensing cap of FIG. 1.

Referring to the drawings, and in particular to FIGS. 1 and 2, there is shown a fluid dispensing cap with tearable lock according to the present disclosure generally referred to as reference numeral 10. When the same reference number is used in different figures of the drawings, the reference number refers to the same or like part.

Cap 10 is for use with a container 54 (partially shown in FIGS. 11-22). Cap 10 has a body 12. Body 12 has a window 16. Cap 10 includes a trigger 14 that actuates a valve mechanism in body 12. Cap 10 also includes a tearable lock closure 20 in window 16.

Tearable lock closure 20 prevents inadvertent actuation of trigger 14 by a user or environment, such as during transit operations.

Tearable lock closure 20 includes a tab 24. Tab 24 is disposed perpendicular to plate 22. Further, tab 24 projects from plate 22. Plate 22 is affixed to body 12 by one or more linking ribs 26, which serve as one or more attachment points. Between plate 22 and window 16 are one or more gaps 28. Gaps 28 can be separated between window 16 and plate 22 by one or more ribs 26.

As shown in FIGS. 7-10, trigger 14 is a hand-actuated trigger that allows fluid to be dispensed from container 54. Trigger 14 is disposed in alignment with and above a tab 24. Trigger 14 has an annular tooth 40 projecting towards plate 22. Annular tooth 40 is disposed on a side of plate 22 that is opposite tab 24.

As shown in FIGS. 3 to 6, tearable lock closure 20 is incorporated in body 12 to prevent trigger actuation until the tearable lock closure is intentionally removed, preferably by a human. In fact, this structure requires an affirmative or positive removal of plate 22 and tab 24 from body 12.

Shown in each of FIGS. 3 to 22 are respective x, y, and z axes of a Cartesian coordinate system oriented with respect to cap 10. Upward, downward, vertical, longitudinal, and the like are used describe movement and or force along the y-axis. Horizontal, lateral, and the like are used to describe movement along the x-axis, the z-axis, or an x-z plane.

Trigger 14 is actuated by application of a downward force 32 on the trigger, towards tab 24 resulting in downward movement. However, tab 24 obstructs the downward movement of trigger 14, thereby preventing actuation. Tab 24 acts as a cantilever.

Actuation of trigger 14 ceases upon removal of force 32 or upon application of an upward force 34. Upward force 34 can be applied by a user or be the result of a biasing mechanism internal to body 12. Force 32 and force 34 occur along the y-axis shown in FIGS. 3-6. It should be noted that minimal displacement of trigger 14 along the y-axis can occur without actuation.

Importantly, force 32, which is an actuation force on trigger 14, does not result in the detachment of tearable lock closure 20.

As discussed above, tearable lock closure 20 is connected to body 12. A force 36 is required to remove tearable lock closure 20 from body 12. Force 36 is applied to tab 24 along the z-axis or rotationally about the y-axis. In certain embodiments, force 36 can also be a rotation of tab 24.

As mentioned above, tearable lock closure 20 has a plate 22. Plate 22 can be planar, but preferably is contoured to conform with or adapt to the shape or curvature of an outer wall 18 of body 12 and in window 16. Plate 22 is affixed along edges 38, in window 16, to body 12 by, in the example of FIGS. 1 to 6, three linking ribs 26. In certain embodiments, plate 22 is rectangular, square, oval, and round in shape.

Tearable lock closure 20 has at least two, preferably at least three, and most preferably at least 4, linking ribs 26. Linking ribs 26 are tearable attachment points for securing tearable lock closure 20 to body 12, prior to removal by a user to commence a first dispensing of fluid.

Linking ribs 26 traverse gap 28, which again, is the space between window 16 and plate 22.

In certain embodiments, linking ribs 26 are rectangular in shape.

In certain other embodiments, linking ribs 26 are cylindrical in shape.

Importantly, when trigger 14 is moved downward or there exists force 32 on trigger 14, linking ribs 26 do not sever so that there is no detachment of tearable lock closure 20. Instead, linking ribs 26 sever upon application of force 36 or a torqueing or twisting of tab 24.

Referring again to FIGS. 7 to 10, cap 10 has a callout areal A/B. Area A is shown more clearly in FIG. 8 and area B is shown more clearly in FIG. 9. Area A shows no force acting upon trigger 14. Area B shows force 32 acting upon trigger 14.

Figure 8:
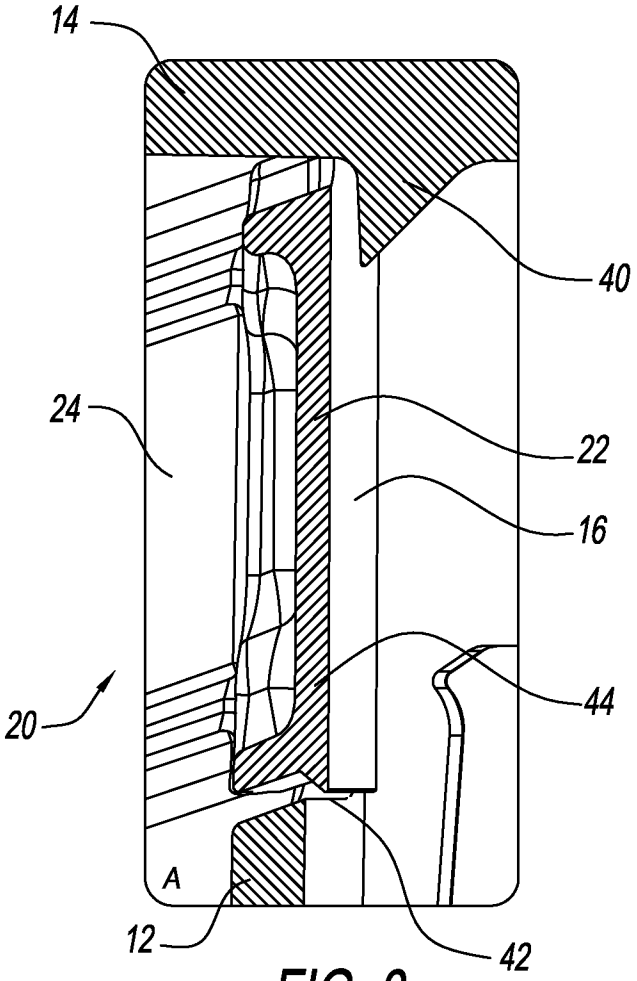
FIG. 8 is an exploded view of area A, in an unactuated position.
Figure 7:
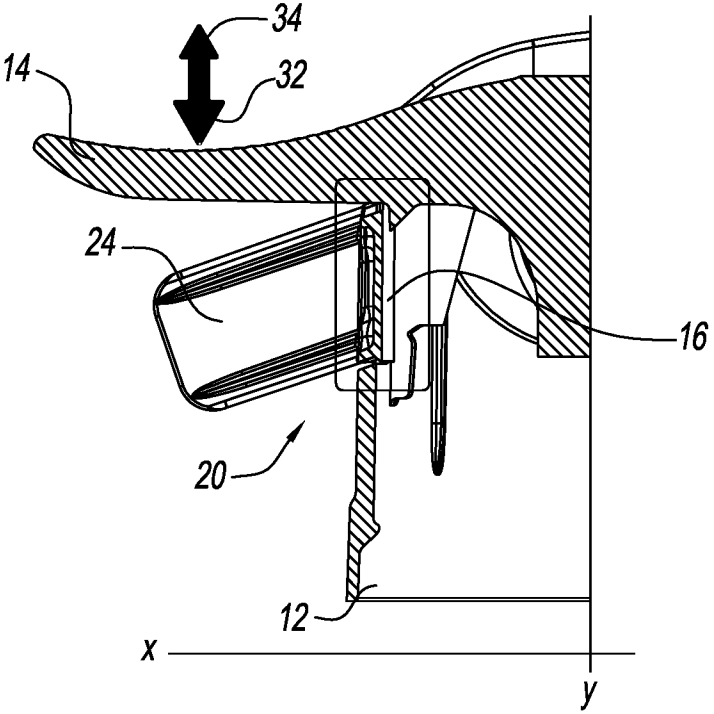
FIG. 7 is a cross sectional view of FIG. 3 with an exploded area A/B.

FIG. 8 shows that trigger 14 and annular tooth 40 are not engaged with tearable lock closure 20. FIG. 8 illustrates the resting position of cap 10.

Figure 9:
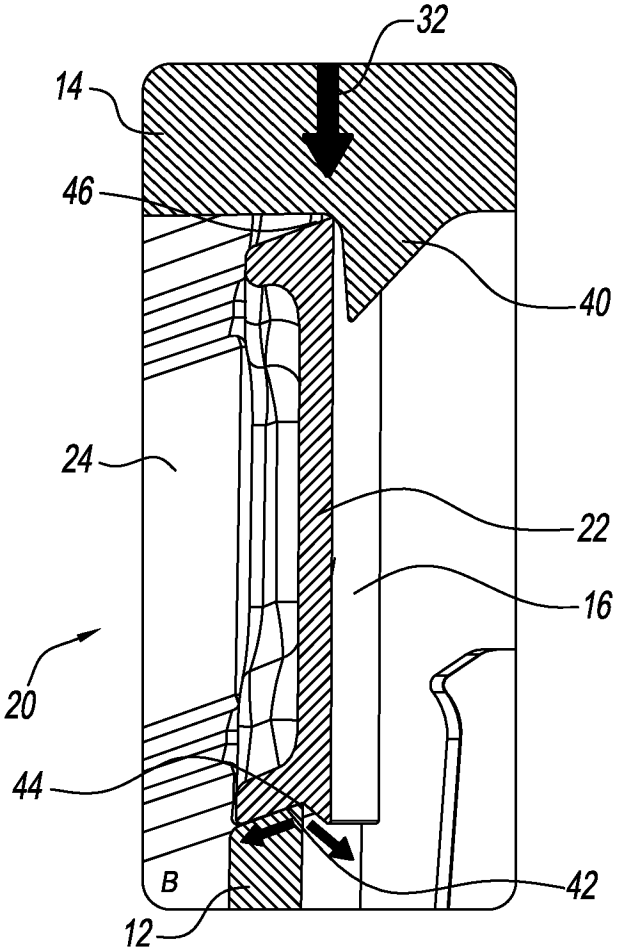
FIG. 9 is an exploded view of area B, in an actuation preventing position.

FIG. 9 shows how tearable lock closure 20 engages trigger 14 to prevent actuation upon application of force 32. Plate 22 has an upper edge 46 that abuts annular tooth 40 of trigger 14. As a result, it is ensured that any inappropriate movement action on trigger 14 will minimally displace tearable lock closure 20 so that upper edge 46 abuts against annular tooth 40. Moreover, plate 22 has a bottom with an annular indentation 44 that engages a lower edge line 42 of body 12 to prevent movement along the x-axis, thus ensuring that any relative movement cannot interfere with locking action. In this way, trigger 14 is prevented from moving.

Lower edge line 42 can have a wedge shape. Lower edge line 42, however, should interlock with annular indentation 44.

Figure 10:
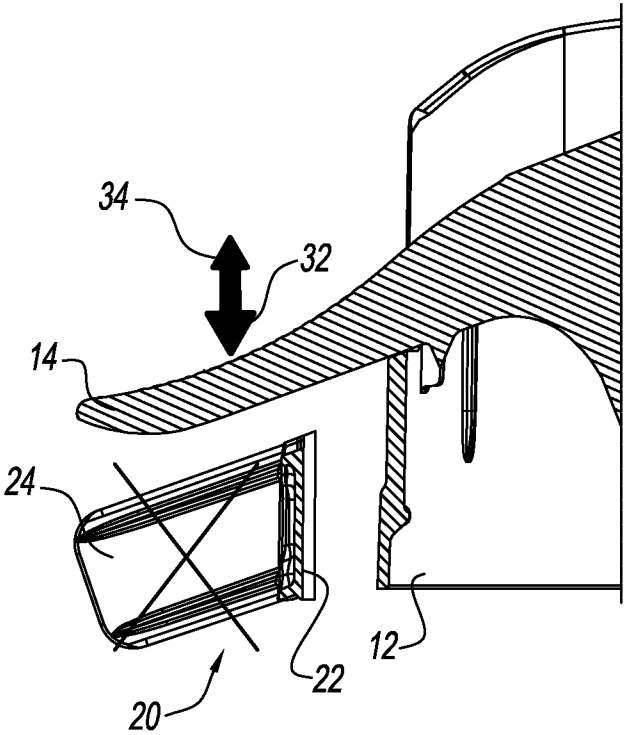
FIG. 10 is the view of FIG. 7 with the tearable lock closure removed from the fluid dispensing cap.

FIG. 10 shows cap 10 with tearable lock closure 20 removed. Trigger 14 can be displaced downward since tearable lock closure 20 no longer obstructs movement.

Referring to FIGS. 11 to 16, there is shown an embodiment of the present disclosure having horizontal fluid dispensing.

Figure 11:
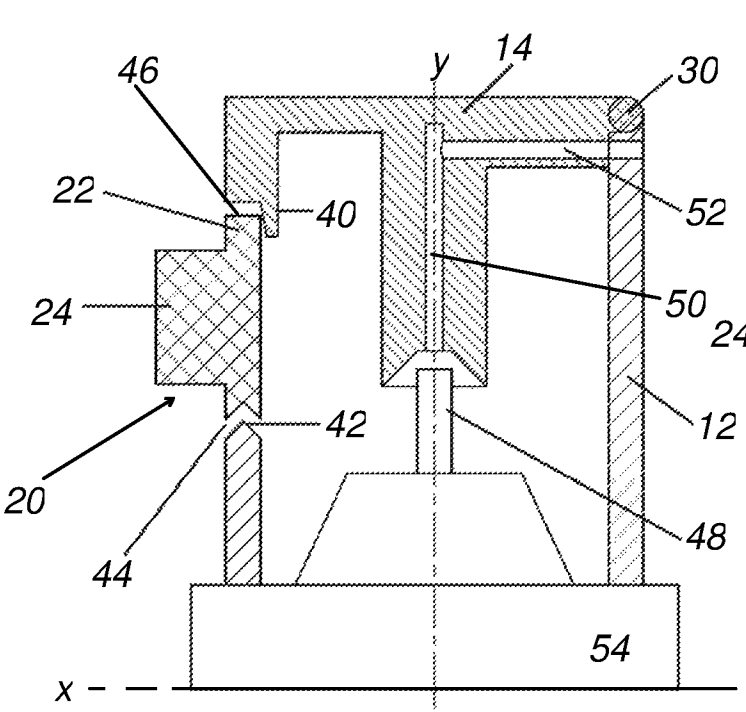

FIG. 11 shows cap 10 in a resting position with no forces acting on trigger 14. Cap 10 is mounted on container 54 to actuate a valve 48 that communicates a fluid in the container with cap 10. In body 12, there is a vertical duct 50 in communication with valve 48 at one or a first end and a horizontal duct 52 through which a fluid is dispensed at the opposite or a second end. As shown, trigger 14 is moveable with respect to body 12 at a pivot joint 30.

Figure 12:
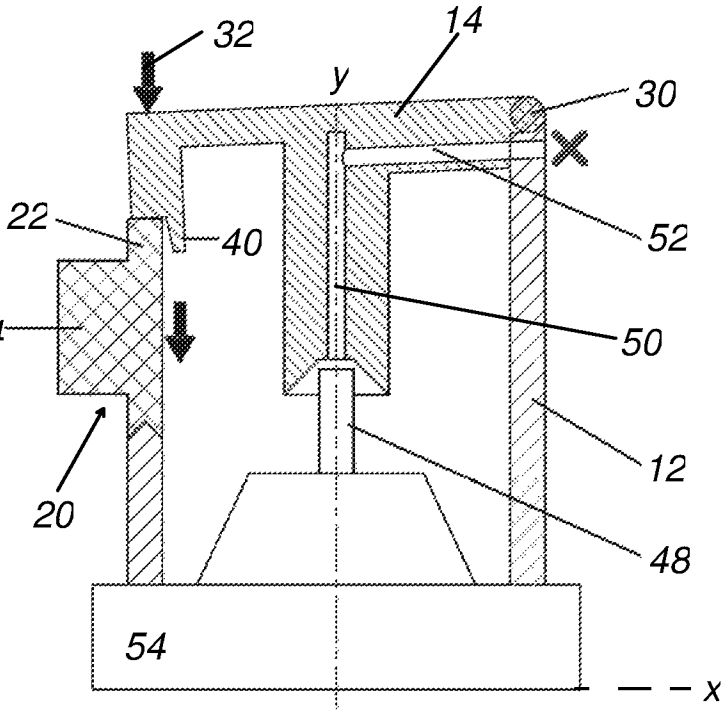
FIGS. 11-16 are cross sectional views of a fluid dispensing cap with tearable lock closure according to an embodiment of the present disclosure having lateral fluid dispensation, shown at various stages of actuation.

FIG. 12 is analogous to FIG. 9 in that it shows that upon application of force 32, trigger 14 is urged against plate 22. Edge line 42 and annular indentation 44 are also urged together, blocking further downward movement of trigger 14 and preventing pivoting at pivot joint 30 and actuation of valve 48.

Figures 13, 14:
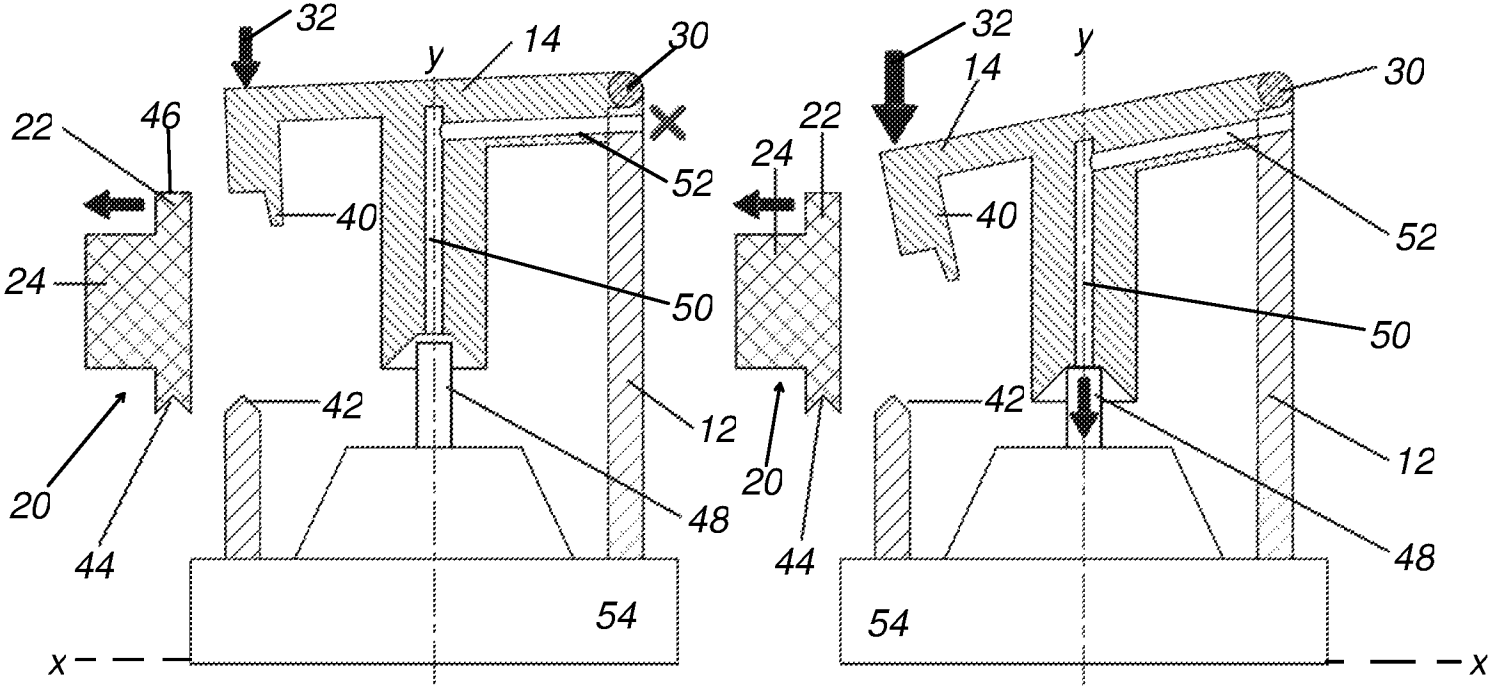

FIG. 13 shows the structure of FIG. 12, however with tearable lock closure 20 removed. Accordingly, there can thus be the desired dispensing of fluid from container 54.

Analogously, FIG. 14 shows trigger 14 pivoting about pivot joint 30. The downward movement of trigger 14 is now also possible since tearable lock closure 20 has been removed. Again, by this removal, there is no prevention of actuation.

Figure 15:
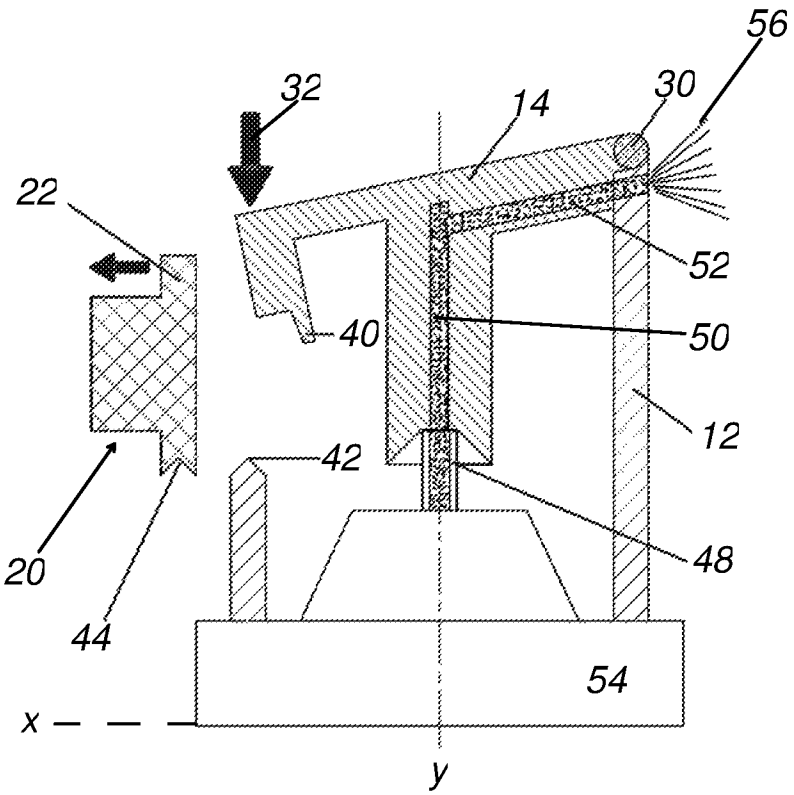

Accordingly, when valve 48 is actuated, as shown in FIG. 15, fluid 56 can be dispensed. Fluid 56 flows through valve 48 through vertical duct 50 and then through horizontal duct 52.

Figure 16:
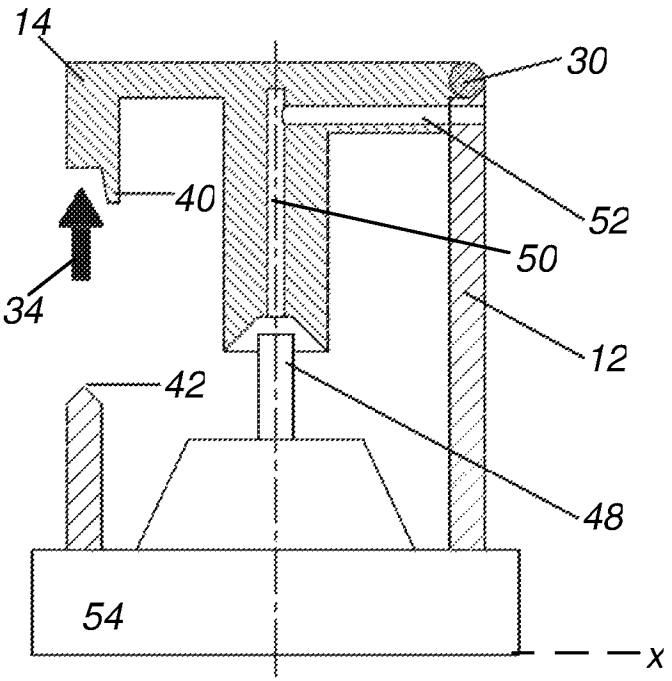

FIG. 16 shows cap 10 with downward force 32 removed. Valve 48 is closed and ceases to allow fluid 56 therethrough. Trigger 14 returns to the resting position. Flow of fluid 56 in vertical duct 50 and horizontal duct 52 is ceased. A user can then continue using cap 10 to dispense fluid 56 from container 54. Advantageously, accidental actuation prior to a first use is avoided.

Referring to FIGS. 17 to 22, there is shown an embodiment of the present disclosure having vertical fluid dispensing.

Figure 17:
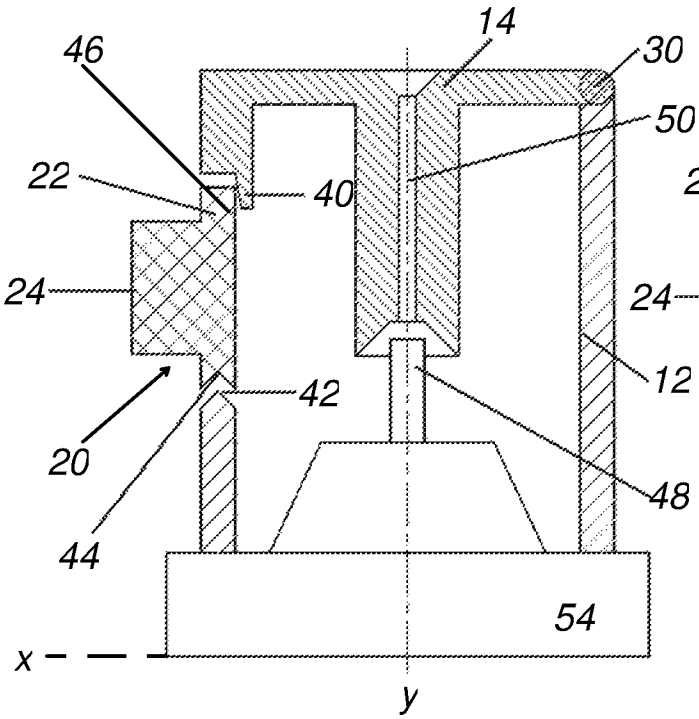

FIG. 17 shows cap 10 in a resting position in which there is no force on trigger 14. Cap 10 is mounted on the top of container 54 that has a valve 48. Valve 48 can be actuated. When actuated, valve 48 communicates fluid 56 in container 54 with cap 10. In body 12, here is a vertical duct 50 that is in communication with valve 48 at a first end and that dispenses fluid 56 at a second end. As shown, trigger 14 is moveable with respect to body 12 at a pivot joint 30.

Figure 18:
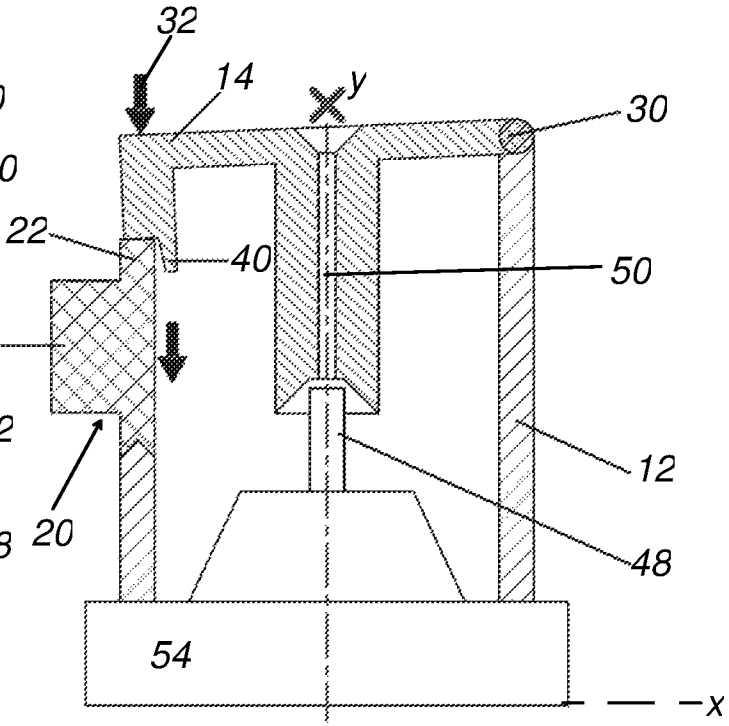
FIGS. 17-22 are cross sectional views of a fluid dispensing cap with tearable lock closure according to an embodiment of the present disclosure having vertical fluid dispensation, shown at various stages of actuation.

FIG. 18 is analogous to FIG. 9 in that shows that upon application of force 32, trigger 14 is urged against plate 22. Edge line 42 and annular indentation 44 are also urged together to block further downward movement of trigger 14 and, thus, prevent pivoting at pivot joint 30 and actuation of valve 48.

Figures 19, 20:
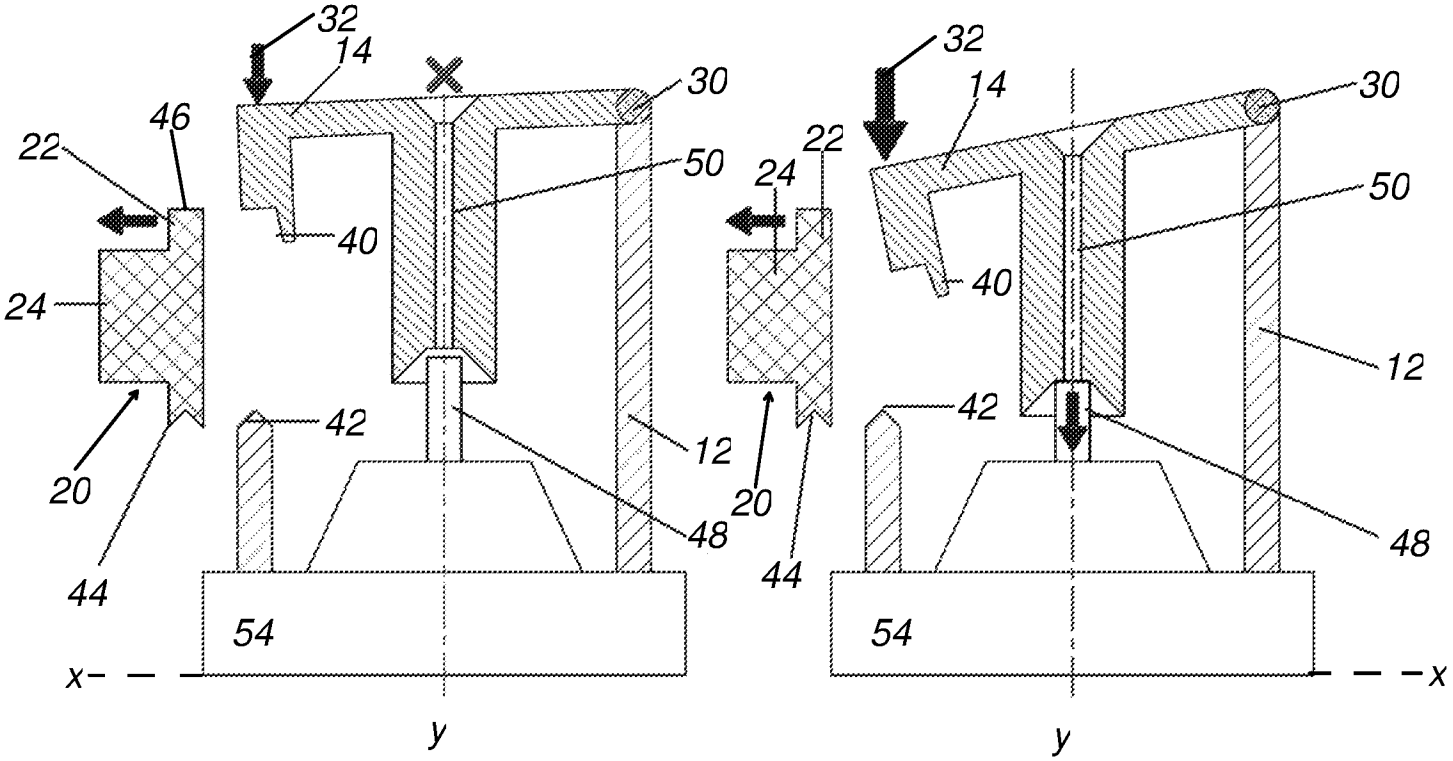

FIG. 19 shows the structure of FIG. 18 but with tearable lock closure 20 removed.

FIG. 20 shows that trigger 14 pivots about pivot joint 30. Since tearable lock closure 20 has been removed and no longer prevents actuation, downward movement of trigger 14 is possible.

Figure 21:
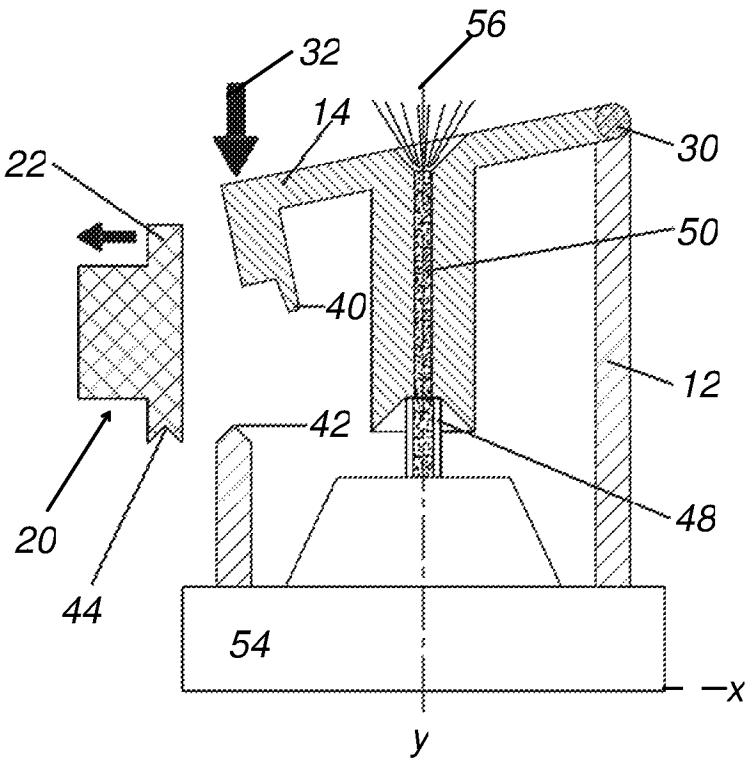

Accordingly, valve 48 is actuated, as shown in FIG. 21, to cause fluid 56 to be dispensed. Fluid 56 flows through valve 48 and through vertical duct 50.

Figure 22:
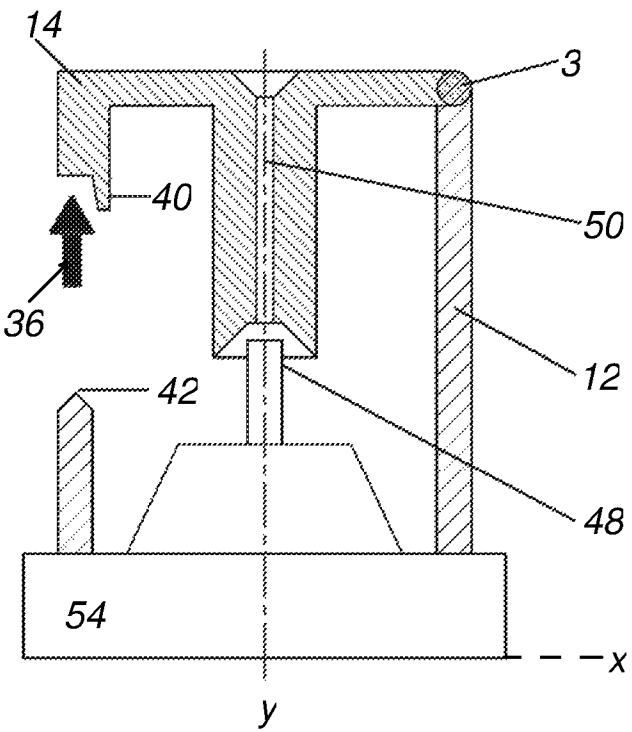

FIG. 22 shows cap 10 with downward force 32 removed. In this situation, valve 48 is closed and ceases to allow fluid 56 therethrough. Trigger 14 is in the resting position. Flow of fluid 56 in vertical duct 50 ceases. Fluid 56 can be further dispensed by re-actuating trigger 14. Since tearable lock closure 20 has been removed, actuation is possible.

In certain embodiments, tearable lock closure 20 can be removed by a user utilizing only two fingers. In some of these certain embodiments, tab 24 has a surface 66 with one or more features 64 thereon. Features 64 include indentations, channels, grooves, corrugations, notches, depressions, and other features that enhance grip and allow easy removal of tearable lock closure 20.

An extension of trigger 14 from wall 18 is longer by a length 60.

An angle 62 between trigger 14 and tab 24 enables a user to more easily grip and remove the tab, without interference from trigger 14.

A container 54 according to the present disclosure includes: Polyethylene Terephthalate (PET) containers, aluminum containers, as well as analogous containers employing fluid dispensing caps. Cap 10 can be used with containers having different shapes and designs, while maintaining equivalent performance.

As used herein, a fluid dispensing cap also refers to a liquid or gas dispensing cap. Accordingly, the term fluid dispensing cap also encompasses dispensing caps for sprays, foams, aerosols, soda, water, or any other fluid product. Importantly, fluid dispensing caps operate to actuate a valve.

It should also be noted that the terms "first", "second", "third", "upper", "lower", and the like can be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes can be made and equivalents can be substituted for elements thereof without departing from the scope of the present disclosure. In addition, many modifications can be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A cap assembly comprising:

a fluid dispensing cap having a trigger vertically operable to actuate a valve, the fluid dispensing cap having a window located below the trigger, wherein the window defines a side edge and a bottom edge;

a plate disposed in the window and configured with a gap between the side edge of the window and the plate, the plate having a tab projecting perpendicularly from an outer surface of the plate, and the plate having a channel in a bottom surface of the plate; and a linking rib connecting the plate to the side edge of the window;

wherein the bottom edge of the window is positioned in the channel, and whereby movement of the trigger is prevented unless the plate and the tab are affirmatively removed.

2. The cap assembly of claim 1, wherein the fluid dispensing cap is cylindrical, and wherein the plate cylindrically conforms to the fluid dispensing cap.

3. The cap assembly of claim 1, wherein the linking rib is at least two linking ribs.

4. The cap assembly of claim 1, wherein the linking rib is at least three linking ribs.

5. The cap assembly of claim 1, wherein the linking rib is hand-tearable by a lateral force on the tab.

6. The cap assembly of claim 1, wherein the fluid dispensing cap can be used with a container of fluid.

7. The cap assembly of claim 6, wherein the container is a PET container.

8. The cap assembly of claim 1, wherein the bottom edge is wedge shaped.

9. The cap assembly of claim 1, wherein the tab has a surface with grip features.

10. The cap assembly of claim 1, wherein the fluid dispensing cap comprises a duct in communication with the valve.

11. The cap assembly of claim 10, wherein the duct has a section laterally disposed to dispense fluid.

12. The cap assembly of claim 11, wherein the fluid is dispensed laterally.

13. The cap assembly of claim 1, wherein the trigger has a bottom portion that comprises an annular tooth projecting therefrom.

14. The cap assembly of claim 13, wherein the plate has an upper edge that faces the annular tooth.

15. A container having a fluid, the container comprising:

a fluid dispensing cap having a trigger vertically operable to actuate a valve of the container, the fluid dispensing cap having a window located below the trigger, wherein the window has a side edge and a bottom edge;

a plate disposed in the window and configured with a gap between the side edge of the window and the plate, the plate having a tab projecting perpendicularly from an outer surface of the plate, and the plate having a channel in a bottom surface of the plate; and a linking rib connecting the plate to the side edge of the window, wherein the bottom edge of the window is disposed in the channel, and whereby movement of the trigger to actuate the valve is prevented unless the plate and the tab are positively removed.

* * * * *